United States Patent [19]

Pazzaglia

[11] 4,177,702

[45] Dec. 11, 1979

[54] DEVICE FOR AUTOMATICALLY FORMING PILES OUT OF STRIPS EXITING FROM A MACHINE ON WHICH THE SAID STRIPS ARE PRODUCED

[75] Inventor: Luigi Pazzaglia, Bologna, Italy

[73] Assignee: Officine Cevolani S.p.A., Bologna, Italy

[21] Appl. No.: 911,392

[22] Filed: Jun. 1, 1978

[30] Foreign Application Priority Data

Jun. 21, 1977 [IT] Italy ..... 3479 A/77

[51] Int. Cl.[2] ..... B65G 57/06; B21D 43/22

[52] U.S. Cl. ..... 83/79; 83/89; 83/91; 83/94; 83/157

[58] Field of Search ..... 83/79, 84, 86, 89, 90, 83/91, 92, 94, 157

[56] References Cited

U.S. PATENT DOCUMENTS

| | | | |
|---|---|---|---|
| 2,224,279 | 12/1940 | Underwood | 83/91 |
| 3,533,319 | 10/1970 | Addis | 83/94 X |
| 3,866,498 | 2/1975 | Jarman | 83/89 |
| 3,933,066 | 1/1976 | Spooner et al. | 83/92 |
| 4,026,421 | 5/1977 | Lotz | 83/79 |
| 4,108,031 | 8/1978 | Dangelmaier et al. | 83/90 |

*Primary Examiner*—Donald R. Schran
*Attorney, Agent, or Firm*—Browdy and Neimark

[57] ABSTRACT

Disclosed herein is a device for automatically forming piles out of strips exiting from a machine on which the said strips are produced, comprising at the top, a pair of parallel rods placed downstream with respect to the said cutting device, and supported at their ends by corresponding brackets connected to the base frame, the said rods being provided centrally with a support member for sustaining the packs of strips in a horizontal position and able to rotate, in opposite directions, in order to release the pack of strips which, once freed, falls, suitably guided, on to a collection pallet placed on a driven conveyor, located downstream of the machine, which continues to operate until a number of vertical piles of strips have been formed on the pallet, after which the pallet is sent towards a discharge station.

7 Claims, 5 Drawing Figures

1
3
4
5
6
10
11
12
13
14
15
16
9
21
54
19
33
20
18
40
39
32
57
45
25
26
27
28
27'
29
30
47
B
B
34
35
36
37
38
53
55
56

DEVICE FOR AUTOMATICALLY FORMING PILES OUT OF STRIPS EXITING FROM A MACHINE ON WHICH THE SAID STRIPS ARE PRODUCED

This invention relates to a device for automatically forming piles out of strips, in particular flat metal strips, exiting from a guillotine type shearing machine.

The said guillotine shearing machines, or other equivalent machines, are commonly used to divide metal sheets of large dimensions up into a certain number of strips of pre-established dimensions, which are subsequently fed to presses for the final parts, such as round bases or lids for metal tins, to be produced through blanking and die forming operations.

Normally the said shearing machines are provided, downstream, with a container into which the strips drop, one on the other, to gradually form a pile. With the containers in use today, it is not possible to form a pile of a considerable height (which could be removed from the container using a fork lift truck) because of the irregular way in which the said strips drop once the dropping height has exceeded a certain value. Thus once the pile has reached a limited height (in the order of a few centimeters), a worker, after having interrupted the shearing machine supply, manually extracts the pile from the container and places it, either directly in the infeed magazine of the press, or else in a suitable place from where the said piles can be removed when required. The said removal of the piles has, therefore, to take place very frequently and, in addition to the fact that the worker concerned has to constantly be used for this very purpose, work has to be continuously interrupted and thus there is a consequential drop in the productivity of the machine.

An essential object of the present invention is, therefore, to overcome the aforementioned problems through the creation of a device that offers the constant automatic formation of piles of strips, a notable reduction in the down-times of the machine and a consequent increase in the production thereof.

This and other objects too have all been attained by the device forming the subject of the present invention, that is to say, a device for automatically forming piles out of strips exiting from a machine on which the said strips are produced, the latter being, for example, a machine of the type that comprises a horizontal table for supporting a sheet to be divided up into strips that is being fed to a cutting device for shearing the said strips perpendicularly to the infeed direction of the said sheet, essential features of the device in question being that it comprises in conjunction: two rods placed downstream of the said cutting device, perpendicularly to the direction in which the said strips exiting therefrom move forward, these being parallel one to the other, and supported, through two brackets placed roughly at the extremities of the said rods, by the bed of the said machine, the said rods, each rotatable around its own axis, being movable with respect to one another to suit the width of the sheared strips, each of the said rods being provided with at least one support member, in an almost central position, provided to sustain the strips in a roughly horizontal position exiting from the aforementioned cutting device resting on one another, the said brackets each being provided with a limit member defining a vertical wall extending below the said rods, on a plane parallel to the direction in which the said strips move forward, the said limit members being provided for the purpose of restraining and guiding the said strips, it being possible to position the said brackets with respect to one another to suit the length of the sheared strip, each of the said members being provided with members, in the region of the plane defined by the said support members, on which the said strips can rest and be sustained jointly with the said support members; means for operating the said rods and for rotating them in opposite directions between two extreme positions, that is to say, the support position and the release position for the strips resting on the said support members, the said operating means being actuated to suit a predetermined number of strips exiting from the said cutting device; a driven endless conveyor placed downstream of the machine, beneath the said rods, movable in a direction parallel to and in harmony with that in which the strips exiting from the cutting device move forward, this designed to accept the packs of strips dropping out of the said rods, until a vertical pile of strips has been formed and to then carry the said pile towards a discharge station; first sensor means placed between the said rods and the said conveyor, to detect when a height pre-established for the pile of strips has been reached, and to consequently cause the said cutting device to cease operating and the said conveyor to subsequently be actuated; and second sensor means placed at the side of said conveyor, to detect that the said conveyor has undergone in the aforementioned direction a displacement at least equal to the width of the pile and to cause, in consequence, the endless conveyor to halt and the said cutting device to resume operation.

Further characteristics and advantages of the invention will emerge more clearly from the following detailed description of a preferred but not the sole form of embodiment for the device in question, illustrated purely as an unlimited example on the accompanying drawings, in which.

Figure 1:
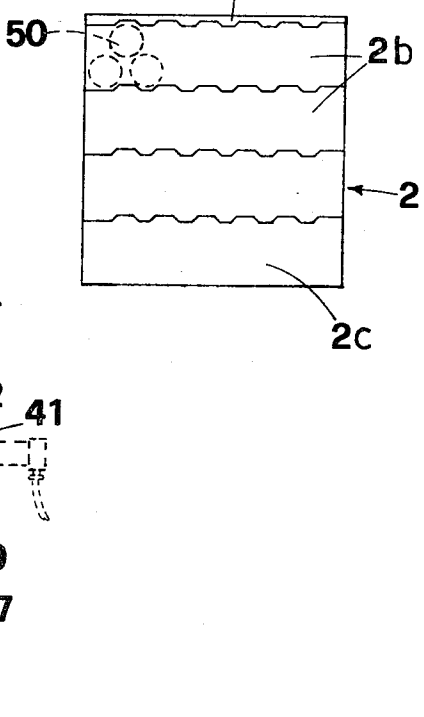
FIG. 1 shows, diagrammatically, an example of how strips are created out of a sheet of large dimensions.

With reference to the accompanying figures, at (1) a machine has been shown for cutting sheets up into strips, and in the case given as an example, this is a guillotine shearing machine consisting essentially of a table (3) onto which, possibly in an automatic fashion using a sheet positioning device of known type which is not shown in the figures, the sheets (2) (see FIG. 1) are placed. The said sheets are fed to a cutting device composed of a punch (4) that is given a reciprocating movement and which, in contrast with a die (5), brings about the shearing of the sheet. The first stroke for each of the said sheets (see FIG. 1) is a trimming cut **(2*a*) which is automatically discharged into a bin provided for this purpose, whilst each of the subsequent strokes shears strips (2*b*) right up to the final strip (2*c*) and the latter does not need to be trimmed. The said strips are then sent to the machine for them to be blanked and punched out in the form of, for example, round bases or lids (50)**

for metal tins. For productivity reasons, the blanking and punching machines are generally provided with twin punches and thus, as shown in FIG. 1, each strip makes provision for this requirement.

Figure 2:
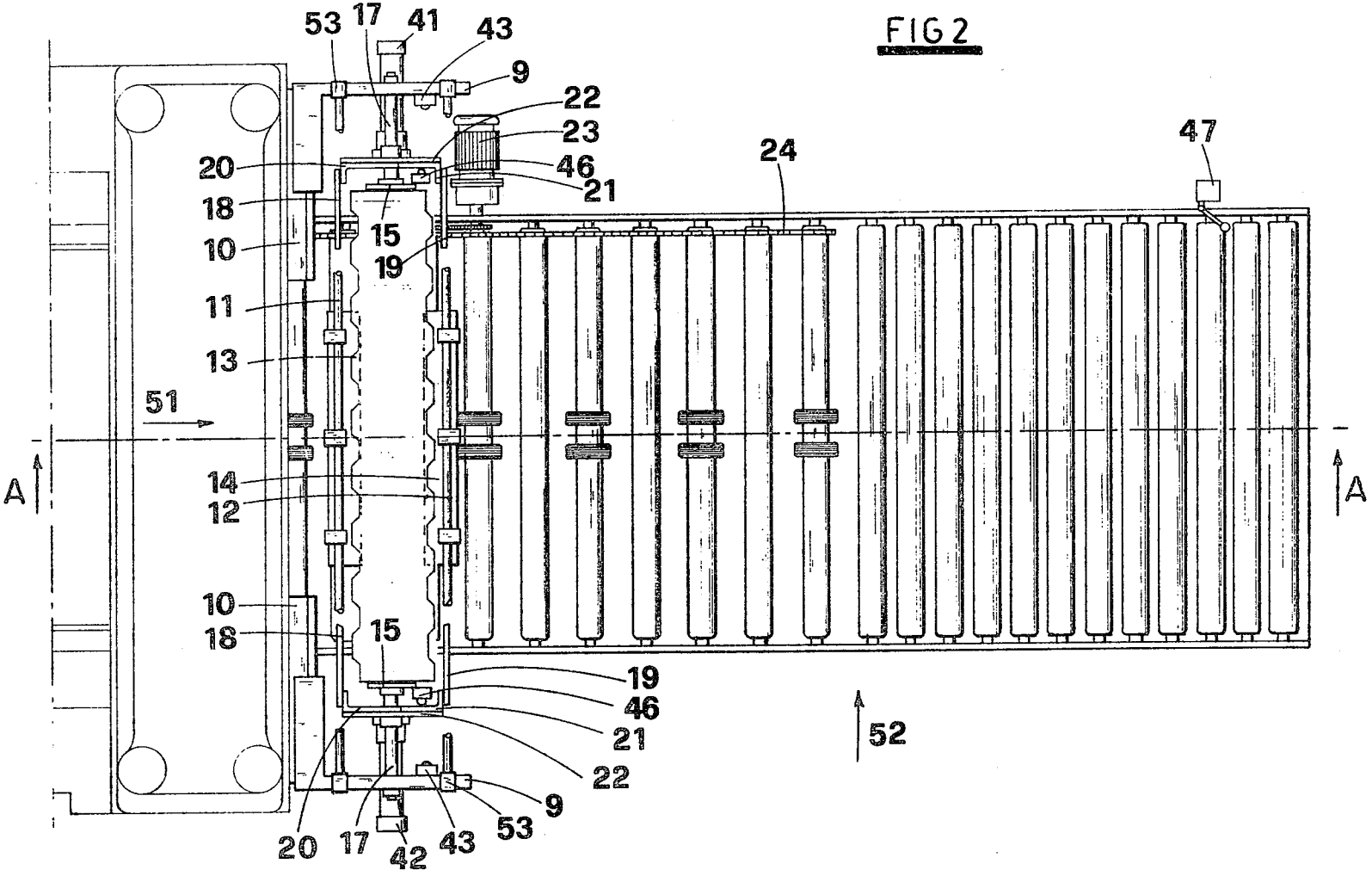
FIG. 2 shows, diagrammatically, in a view seen from above, the device in question fitted to a guillotine shearing machine or to some other equivalent machine of known type.

The said strips exiting from the cutting device and following the movement direction shown in FIG. 2 with the number (51), arrive at the device for automatically stacking them, that is to say, at the device forming the subject of the present invention.

This consists essentially of two support brackets (9) that are able to slide in the two directions, in a direction belonging to the plane in FIG. 2 and perpendicular to the direction in which the strips move forward, shown with the number (52), on corresponding horizontal guides (10) integral with the bedplate (6) of the machine. The said brackets can be locked with respect to the said guides, the purpose of this being to match the distance in between the brackets (9) witth the length of the strips to be stacked.

The said brackets support two long rods (11) and (12), respectively, placed immediately downstream of the said cutting device, horizontal and perpendicular to the direction in which the said strips exit therefrom, and they are rotatable around their individual axes and can be positioned one with respect to the other. More precisely, the rod (11) is at a fixed distance from the bedplate (6) of the machine, whilst the rod (12) can be displaced parallel to the other rod, in such a way as to match the distance they are apart with the width of the strips to be stacked (the actual positioning is entrusted to a registration device (53) belonging to the rod (12) (see FIG. 2)). In roughly a central position, the said rods (11) and (12) are provided with two angular supports (13) and (14), respectively, that define a horizontal plane and are there to support the strips exiting from the cutting device. Between the said rods there are two limit members (15) that are secured to the said brackets (9). In the case under consideration the said limit members are constituted by walls that extend vertically from the said rods to a pile formation plane below, more about which will be said in due course. The said walls (15) are secured to the said brackets (9) through a pair of horizontal rods (17) (see in particular FIG. 4).

The opposite vertical walls (15) are provided with the support members (16), placed on the horizontal plane defined by the aforementioned angular supports (13) and (14) which, together with the latter, contribute in sustaining the strips exiting from the said cutting device. The distance one vertical wall (15) is away from the other, which can be adjusted by positioning the brackets (9), is obviously equal to the length of one strip.

At the side of the said vertical walls (15), on opposite sides thereto, that is to say, at points corresponding to the extremities of the pile of strips being formed, two other vertical walls (18) and (19), respectively, are placed, and these extend parallel to the aforementioned rods (11) and (12) for a height that includes them and the pile formation plane. The said vertical walls (18) and (19) are fastened, through the small angular brackets (20) and (21) to the plates (22) that can be slid along the pair of horizontal rods (17). Whilst the angular brackets (20) are stationary with respect to the plates (22), the angular brackets (21) are provided with adjustment slots (54) and they can be locked with respect to the said plates (22) to suit the width of the strips to be stacked.

The vertical walls (15), (18) and (19) act as guides for the strips, or rather for the pack of strips (33), during its vertical drop out of the support members (13) and (14).

Figures 3, 5:
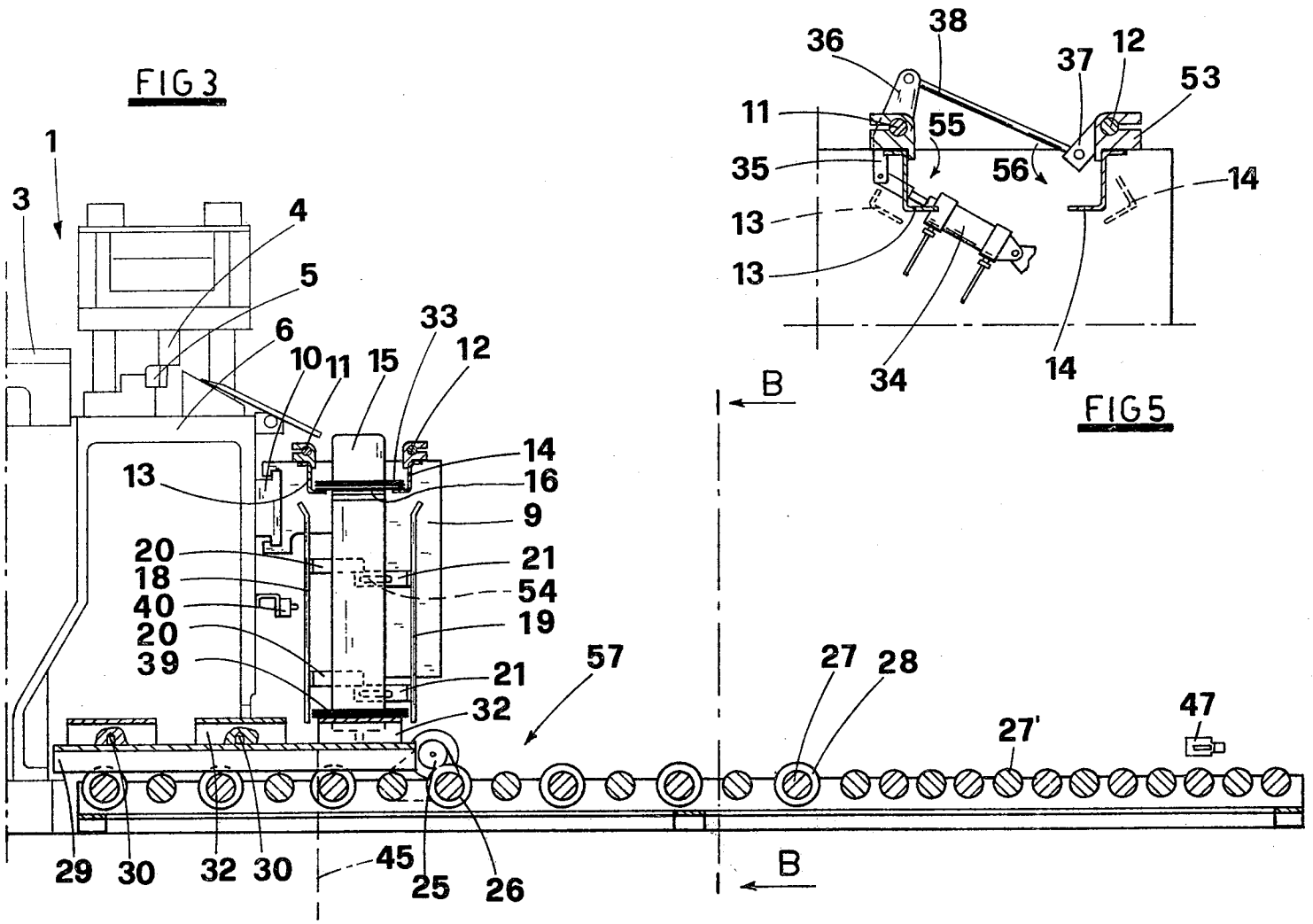
FIG. 3 shows, in sectional form, a view along the line A—A in FIG. 2 of the device in question.
FIG. 5 shows, diagrammatically, a detail of the device in question.

The rotation of the rods (11) and (12) in opposite directions to one another, until the angular supports (13) and (14) have been carried from the strip support position shown in FIG. 5 to the strip release position shown again in FIG. 5, this time with dotted lines, is controlled by a cylinder (34), the body of which is pivotally connected to an extension integral with one of the brackets (9), whilst the cylinder rod is pivoted to an arm (35) integral with the rod (11). Through the two arms (36) and (37), integral with the rods (11) and (12), respectively, and the tie rod (38) articulated to the said arms, each rotation the cylinder (34) gives the rod (11), in the direction indicated in FIG. 5 with the number (55), causes an equal rotation on the part of the rod (12) in the opposite direction numbered (56).

Figure 4:
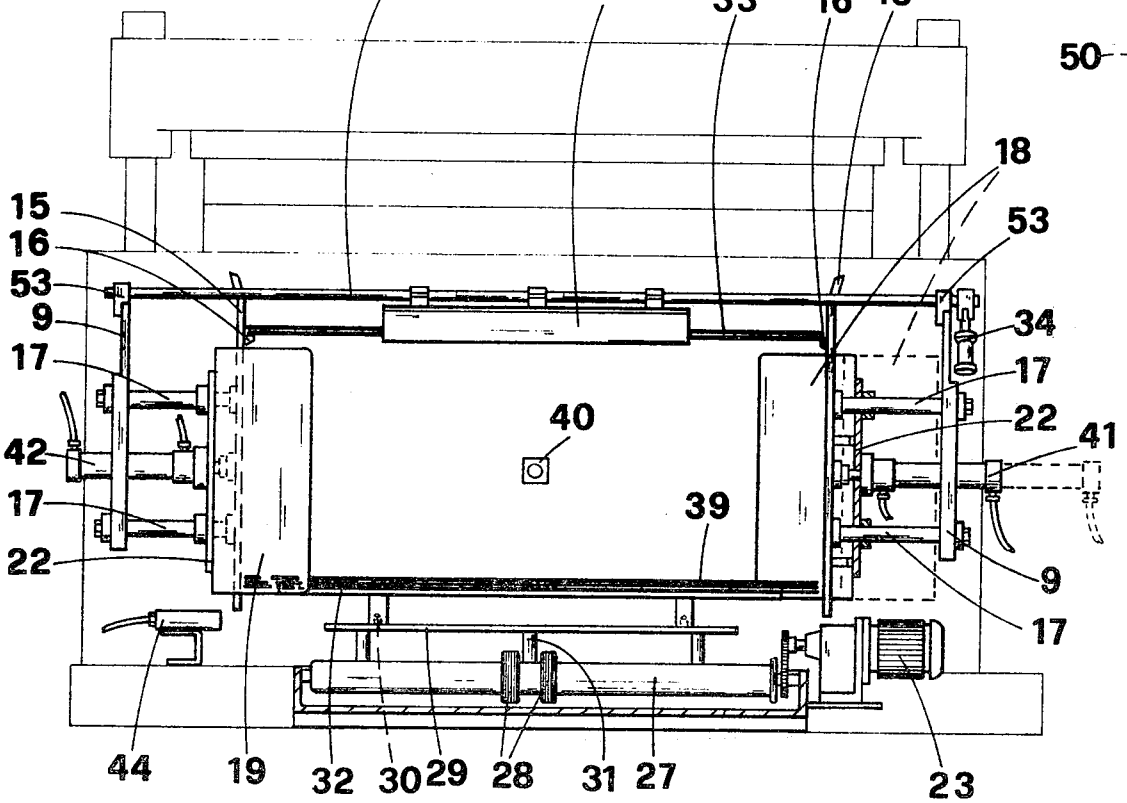
FIG. 4 shows, in sectional form, the device in question along the line B—B in FIG. 3.

The vertical walls (18) and (19) are movable in the two directions, along the direction indicated with the arrow (52), between two extreme positions, that is to say, a forward position shown in FIG. 2, laterally at the extremities of the pile being formed, and a rear position wherein they are out of operation, as can be seen in dotted lines in FIG. 4. More will be said about the latter position in due course. The movement of the said vertical walls (18) and (19) is achieved through a pair of cylinders (41) and (42), respectively, the body of which is connected to the plate (22), whilst the rod is integral with the vertical wall (15). Underneath the said rods (11) and (12), in the region of the resting plane of the machine, an endless roller type conveyor (57) is placed and this is designed to support a charging pallet (29) on which the piles of strips are formed, and to feed the said piles along a direction shown in FIG. 2 with the number (51). The said conveyor is constituted by a number of driven rollers (27), that is to say those on the plane closest to the machine, whilst the rollers (27') positioned towards the exit from the plane idle.

The drive given to the rollers (27) is controlled by a geared motor (23) through a transmission chain (24) and a drive pinion (25) and a driven pinion (26). The driven rollers, or just a certain number of them (alternate rollers, for example, as in this particular instance) are provided, in their central part, with a pair of annular projections (28) having a guide function, as will be seen better in due course.

To complete the device in question, at (40), (43), (46), (44)) and (47) sensor means are provided, and the operation of these will be clarified in the following description of the operation of the device in question.

Prior to setting in operation the shearing machine for the cutting of the strips, an operative places on the conveyor (57) a member for sustaining the pile under formation which, in this particular instance, is constituted by a pallet (29) whose upper plane is equipped with reference means, for example, dowels (30), placed in position at suitable intervals. The said suitably spaced dowels serve to position an identical number of pile carrying plates (32) that singularly act as the base plane in the formation of a pile, the said plates being of dimensions in keeping with and corresponding to the formation of the strips to be stacked, and within certain limits they can be interchanged with others of different dimensions.

The annular projections (28) in the driven part (27) of the endless conveyor (57) serve to guide the pallet (29) which for this very purpose is provided with a centre piece (31) (see FIG. 4).

With the pallet positioned in contact with the bedplate of the machine and the first pile carrying plate placed in the region of but underneath the rods (11) and (12), that is to say, in the position depicted in FIG. 3, the operative sets the machine going. In this phase the rods (11) and (12) are in the position shown with an unbroken line in FIG. 5, the vertical walls (18) and (19) are in the extreme forward position shown in FIG. 2, and the conveyor (57) is at a standstill.

The strips exiting from the cutting device enter the chamber defined by the angular supports (13) and (14) and by the vertical walls (15), and resting on the said angular supports (13) and (14) and on the support members (16) of the vertical walls (15), they commence the formation of a pack (33). Once a certain number of strips have been sheared, that is to say, once a pack (33) of strips of a certain height has been formed, a cylinder (34) is made to operate, through for example a cam located on the shearing machine actuating a valve not shown in the figures, and this brings about a rotation of the rods (11) and (12) until the angular supports (13) and (14) have been carried into the position shown with a dotted line in FIG. 5. The pack (33) of strips, no longer sustained centrally by the supports (13) and (14), and resting solely on the support members (16), undergoes an inflexion and falls out of the support members (16) into the compartment beneath the plate (32).

The reason for the prestacking in packs of a limited number of strips on the supports (13) and (14) is due to the fact that if the strips exiting from the punch (4) were left to drop directly, one at a time, onto the pile carrying plate (32) placed at the bottom of the chamber delimited by the vertical walls (15), (18) and (19), the said strips would, during the drop, adopt an irregular movement on account of the resistance of the air and the rubbing against the said walls, and this could lead to the strips being damaged through the drop and correct stacking being compromised.

When instead a pack of strips drops, it does so with great regularity since the drop commences contemporaneously at all points of the strips constituting the pack, and they remain in reciprocal contact for the full span of the fall, constituting as it were, one single body on which, because of its own weight, the resistance of the air and the rubbing against the vertical walls (15), (18) and (19), do not exert an excessive influence, and this is also thanks to the particular conformation of the inflected pack on the part of the support members (16). This phase repeated a number of times leads to the formation, on the pile carrying plate (32), of a pile (39), the height of which is limited solely for practical reasons. When the pile reaches this height which is determined by a sensor (40) integral with the bedplate of the machine, the said sensor gives a signal and via suitable electrical equipment this results in:

- the cutting device or the sheet positioning device that feeds the shearing machine being rendered non-operative;
- the cylinders (41) and (42) being actuated until the vertical walls (18) and (19) have been carried into their extreme rear position, that is to say, beyond the maximum length of the strip, leaving the extremities of the pile (39) completely free.

Corresponding to this further phase, the plates (22) knock against a pair of switches (43) which, just in this case, give a signal which controls the operation of the geared motor (23) of the endless conveyor, which carries the pallet to a displacement in the direction indicated by the arrow (51).

A sensor device (44), in this particular instance, a reflection type photoelectric cell, is placed with its axis on the vertical plane (45) in such a way as to be aligned with the rear edge of a pile carrying plate (32) at the time this is in the charging position shown in FIG. 3. Through suitable electrical equipment, the said sensor (44) emits a signal only when the beam reflected from the pile carrying plate ceases, which occurs once the subsequent plate (32) has reached the charging position, that is to say, the position in which:

- the geared motor (23) and then the pallet (29) become non-operative;
- the cylinders (41) and (42) operate in the reverse direction to previously, until the vertical walls (18) and (19) are carried into the extreme forward position shown in FIG. 2, that is to say, the position in which the plates (22) cause a second pair of switches (46) to be tripped.

Once both switches are tripped, they emit a signal which, through suitable electrical equipment, causes the cutting device or the sheet positioning device to start up again. These phases are repeated in succession until the charging of the last pile carrying plate (32) has been effected. At this juncture, once the geared motor (23) has been set in motion and since the sensor (44) does not emit any signal due to the absence of the plates (32), the movement of the driven rollers (27) continues and the pallet (29) is made to move forward up to the extremity of the roller conveyor and to only stop once it is fully resting on the idle roller group (27').

At this stage a limit switch (47) is activated and this brings about the halting of the geared motor (23) and the contemporaneous emission of a visual or sound signal in order to draw the attention of the operative so that he can then place on the roller plane, in the driven part, a fresh pallet, in the exact position shown in FIG. 3, thereby giving rise to a new strip shearing and stacking phase. Subsequently, using for example, an ordinary fork lift truck, the loaded pallet standing on the idling rollers of the conveyor (57) can be removed and taken to the next machine for the operations envisaged to be performed.

It is thus obvious that the invention in question fully satisfies the pre-set object, particularly as regards limited machine interruptions for the removal of the strips stacked, and thus offers a consequential rise in the productivity thereof.

The invention, in its practical form of embodiment, can also differ from the foregoing description and, in particular, numerous modifications of a practical nature can be made to the constructional details without in any way constituting a deviation from the framework of protection afforded to the present invention.

What is claimed is:

1. Device for automatically forming piles out of strips exiting from a machine on which the said strips are produced, the latter being, a machine of the type that comprises a horizontal table for supporting a sheet to be divided up into strips that is being fed to a cutting device for shearing the said strips perpendicularly to the infeed direction of the said sheet, essential features of the device in question being that it comprises in conjunction: two rods placed downstream of the said cutting device, perpendicualrly to the direction in which the said strips exiting therefrom move forwad, these being parallel one to the other, and supported, through two brackets placed roughly at the extremities of the said rods, by the bed of the said machine, the said rods, each rotatable around its own axis, being movable with respect to one another to suit the width of the sheared strips, each of the said rods being provided with at least one first support member, in an almost central position, provided to sustain the pack of strips in a roughly horizontal position exiting from the aforementioned cutting device resting on one another, the said brackets each being provided with a limit member defining a vertical wall extending below the said rods, on a plane parallel to the direction in which the said strips move forward, the said limit members being provided for the purpose of restraining and guiding the said strips, it being possible to position the said brackets with respect to one another to suit the length of the sheared strip, each of the said limit members being provided with second support members, in the region of the plane defined by the said first support members, on which the said strips can rest in packs and be sustained jointly with the said first support members; means for operating the said rods and for rotating them in opposite directions between two extreme positions, that is to say, the support position and the release position for the pack of strips resting on the said support members, the said operating means being actuated to suit a predetermined number of strips exiting from the said cutting device; a driven endless conveyor placed downstream of the machine, beneath the said rods, movable in a direction parallel to and in harmony with that in which the strips exiting from the cutting device move forward, this designed to accept in succession the packs of strips dropping out of the said rods, until a vertical pile of strips has been formed and to then carry the said pile towards a discharge station; first sensor means placed between the said rods and the said conveyor, to detect when a height pre-established for the pile of strips has been reached, and to consequently cause the said cutting device to cease operating and the said conveyor to subsequently be actuated; and second sensor means placed at the side of the said conveyor, to detect that the said conveyor has undergone in the aforementioned direction a displacement at least equal to the width of the pile and to cause, in consequence, the endless conveyor to halt and the said cutting device to resume operation.

2. Device according to claim 1, additionally comprising: two pairs of additional vertical walls placed parallel to the said rods, in the proximity of the extremities of the pile of strips under formation, on opposite sides thereto, these extending for a height that includes the said rods and the pile formation plane, the said additional vertical walls being suspended from the said brackets and it being possible to position them parallel one to the other so as to suit the width of the pile of strips, the said additional walls being designed to guide, along with the aforementioned limit members, the packs of strips during the drop from the said rods during the pile formation; control and positioning means connected to the said additional vertical walls, able to position them in a direction perpendicular to that in which the strips exit from the aforementioned cutting device, between two extreme positions, that is to say, a forward position, laterally to the ends of the pile of strips, whilst the latter is being formed, and a rear position beyond the length of the strips, whereby they are out of operation, during the transfer phase, respectively, on the part of the said endless conveyor, of the already formed pile.

3. Device according to claim 2, wherein the positioning of the additional vertical walls in the extreme rear position is controlled by the said first sensor means and the positioning thereof in the extreme forward position is controlled by the said second sensor means, essential features being that it comprises electromechanical means actuated by the said additional vertical walls in the region of the extreme rear and the extreme forward positions, respectively, designed to control the operation of the said conveyor and to cause the said cutting device to resume operation, respectively.

4. Device according to claim 2, wherein the said limit members comprise two flat vertical walls (15), which are secured to the said brackets through horizontal rods and that the said additional vertical walls (18) and (19), respectively, are supported by the said rods; the said means for controlling and positioning the additional vertical walls being constituted by two cylinders, the rod of each being fixed to one of the two vertical walls (15) and the body to the said additional vertical walls (18) and (19).

5. Device according to claim 1, additional comprising, a pallet placed on the said endless conveyor, provided with a plurality of pile carrying plates dimensioned to suit the strips to be stacked, these being placed on the pallet at suitable distances apart, in a direction crosswise to that in which the strips advance on the machine, the said pallet being located in the stacking position, with one of the aforementioned plates positioned underneath the said rods, said second sensor means includes a photoelectric cell for detecting the arrival of one of the said plates into the predetermined stacking position, and in consequence, to cause the said conveyor to cease moving.

6. Device according to claims 1 or 2, wherein the said conveyor comprises a number of driven rollers placed immediately downstream of the strip shearing machine, and of a number of idling rollers that follow on after the driven rollers.

7. Device according to claim 6, wherein the said rollers are, in an almost central position, provided with a pair of annular projections, the purpose of these being to guide the pallet while it is moving forward.

* * * * *